United States Patent [19]

Wiece

[11] Patent Number: 4,911,428

[45] Date of Patent: Mar. 27, 1990

[54] PUNCHING BAG SUPPORT

[76] Inventor: Richard N. Wiece, 1911 SE. 10th Ave., Cape Coral, Fla. 33990

[21] Appl. No.: 335,490

[22] Filed: Apr. 10, 1989

[51] Int. Cl.[4] ..... A63B 69/00

[52] U.S. Cl. ..... 272/78; 273/55 R; 248/325

[58] Field of Search ..... 272/76, 77, 78, 70 A; 273/55 R, 55 A; 119/29; 248/188.4, 324, 325, 343, 344; 414/569

[56] References Cited

U.S. PATENT DOCUMENTS

| | | | |
|---|---|---|---|
| 2,234,364 | 3/1941 | Carberry | 273/55 R |
| 4,186,922 | 2/1980 | Ketchum | 273/55 R |
| 4,345,755 | 8/1982 | Eidson | 272/78 |

*Primary Examiner*—Stephen R. Crow

*Attorney, Agent, or Firm*—Fleit, Jacobson, Cohn, Price, Holman & Stern

[57] ABSTRACT

A support for a punching bag having a generally horizontally disposed beam supported from an overhead support for rotation about a vertical axis with a heavy punching bag supported at one end of the beam and an adjustable caster wheel at the other end of the beam for rolling engagement with an overhead support to enable the heavy punching bag to move in a circle having a center defined by the rotational axis of the beam with the heavy punching bag being capable of movement in either a clockwise or counterclockwise direction. The caster wheel is vertically adjustable to vary the rotational movement of the punching bag and the use of the punching bag and support of this invention enables a person to practice various aspects of boxing without a sparring partner and also enables a regimen of various exercises to be practiced.

5 Claims, 1 Drawing Sheet

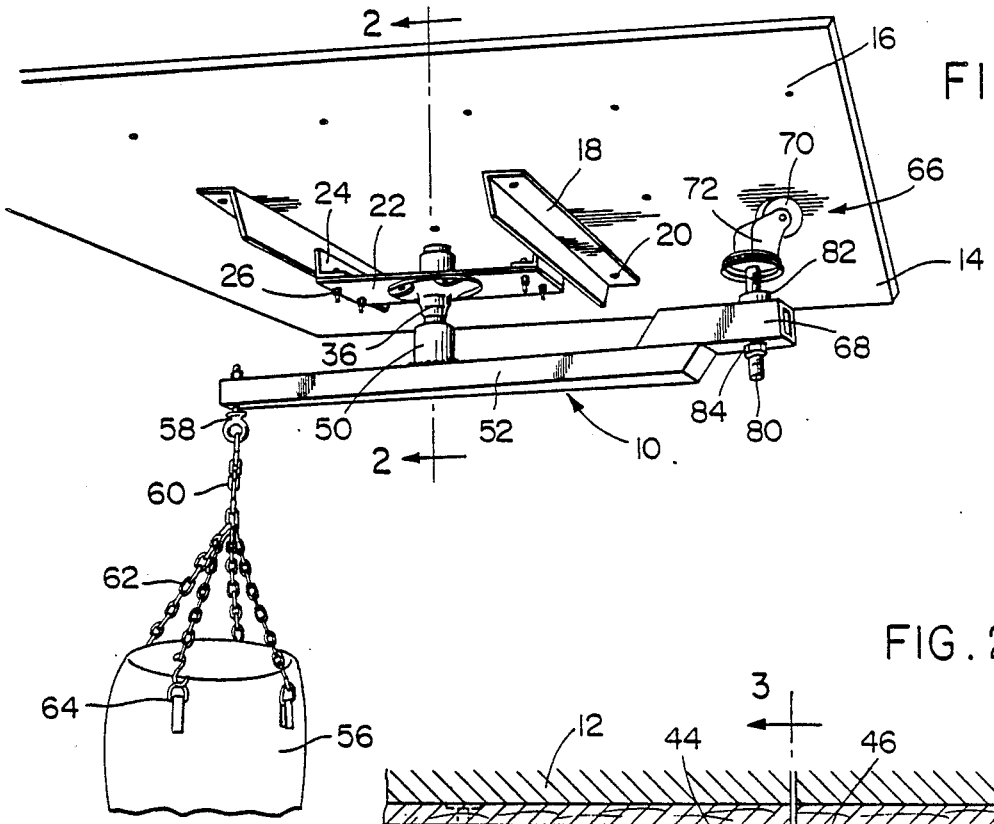
FIG. 1
FIG. 2
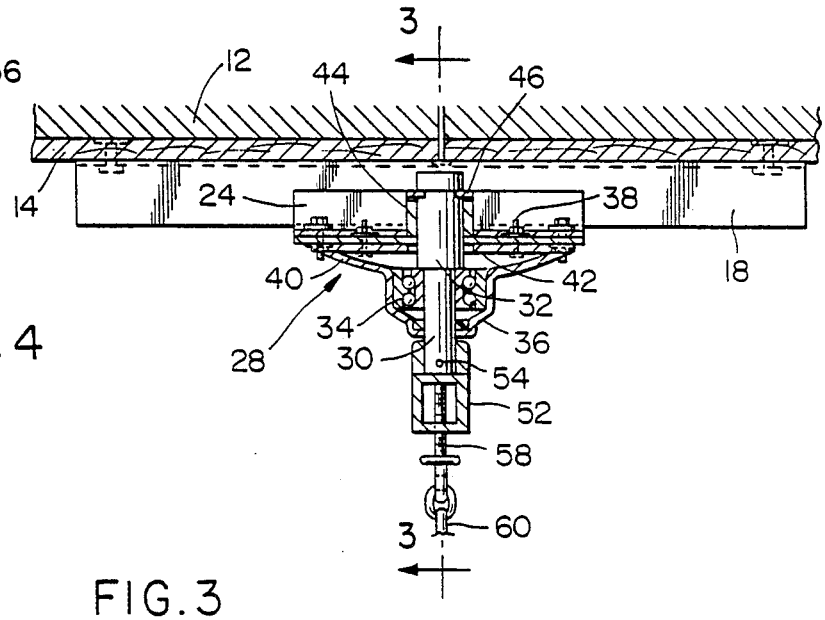
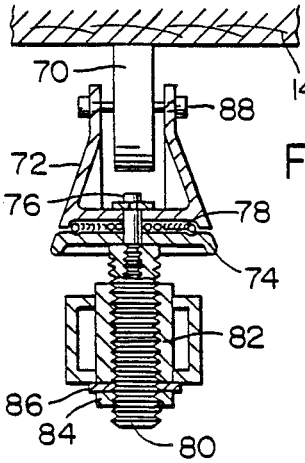
FIG. 4
FIG. 3
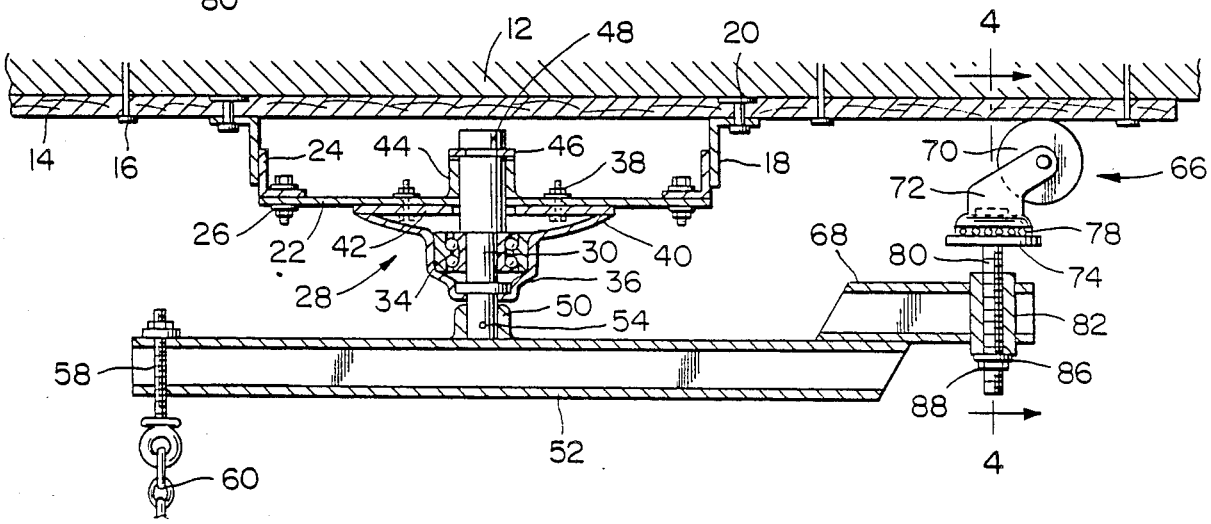

PUNCHING BAG SUPPORT

BACKGROUND OF THE INVENTION

1. Field of the Invention

The present invention generally relates to a support for a punching bag having a generally horizontally disposed beam supported from an overhead support for rotation about a vertical axis with a heavy punching bag supported at one end of the beam and an adjustable caster wheel at the other end of the beam for rolling engagement with an overhead support to enable the heavy punching bag to move in circle having a center defined by the rotational axis of the beam with the heavy punching bag being capable of movement in either a clockwise or counterclockise direction. The caster wheel is vertically adjustable to vary the rotational movement of the punching bag and the use of the punching bag and support of this invention enables a person to practice various aspects of boxing without a sparring partner and also enables a regimen of various exercises to be practiced.

2. Information Disclosure Statement

In the development of boxing skills, punching bags are used in various manners. A lightweight inflated bag is usually supported from an overhead support by a universal connection and a large or heavy bag usually is supported from an overhead by an eye-bolt and supporting chains or the like. The use of the heavy bag is to develop power skills and movement skills but the bag is normally supported from a stationary point on an overhead support. Some efforts have been made to support a heavy bag so that the bag is movable in a circular path. However, prior art devices do not disclose a structure equivalent to that of this invention.

SUMMARY OF THE INVENTION

An object of the present invention is to provide a punching bag support that is positioned in an overhead arrangement and can be fastened to a ceiling of a gymnasium, garage, basement, attic or the like with the supporting structure including an elongated generally horizontally disposed beam mounted from an overhead support for rotation about a generally vertical axis with the heavy bag being supported from one end of the beam and an upwardly extending swivel or caster wheel supported at the other end of the beam to engage a ceiling panel or plate which enables the heavy bag to rotate in a circular path in a clockwise or counterclockwise direction thereby enabling the boxer to develop skills to improve his leg work as well as his punching skills with the counterclockwise movement especially aiding in the boxer training to fight a left-handed boxer since a left-handed boxer will circle in a direction opposite to a right-handed boxer.

Another object of the invention is to provide a punching bag support in which the swivel or caster wheel is vertically adjustably mounted on the beam to enable the caster wheel to be vertically adjusted to increase or decrease the speed of rotation of the beam and bag by tightening or loosening the pressure of the swivel wheel against the ceiling platform.

A further object of the invention is to provide a punching bag support which enables a boxer to move the heavy bag in both rotational directions and eliminates the necessity of having a live sparring partner to develop boxing skills and enables the device to be used for extended periods of time without maintenance except possibly a lubrication at infrequent intervals.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the punching bag support of the present invention illustrating the orientation of the components.

FIG. 2 is a vertical, sectional view taken substantially upon a plane passing along section line 2—2 on FIG. 1 illustrating specific structural details of the rotational support structure for the beam.

FIG. 3 is a vertical, sectional view taken substantially upon a plane passing along section line 3—3 on FIG. 2 illustrating further structural details of the invention.

FIG. 4 is a vertical, sectional view taken substantially upon a plane passing along section line 4—4 on FIG. 3 illustrating the specific structural details of the vertically adjustable swivel wheel.

DESCRIPTION OF THE PREFERRED EMBODIMENT

The punching bag support of this invention is generally designated by reference numeral 10 and is supported from a ceiling or overhead support 12 and includes a rigid panel or plate 14 which may be a wooden panel or metal as well as plastic with the panel being secured to the ceiling by any suitable fasteners 16 so that the panel 14 is stationary and rigidly and fixedly supported from the ceiling 12.

Attached to the panel 14 is a pair of elongated right angular supporting brackets 18 supported from the panel 14 by fasteners 20. A plate 22 extends between L-shaped brackets 24 attached to the depending flanges of the brackets 18 with the plate 22 being secured to the L-shaped brackets 24 by fasteners 26.

Attached centrally to the plate 22 is a swivel connection generally designated by the numeral 28 which includes a vertical shaft 30 extending vertically through the swivel connection and including a shoulder 32 that engages a ball bearing assembly 34 that has the outer race supported in a housing 36 that is secured to the plate 22 by fastening bolts 38. The housing 36 includes an outwardly flared portion 40 that includes a plate 42 underlying and engaging the plate 22 as illustrated in FIG. 3 with the fasteners 38 extending through the plates 22 and 42. A sleeve 44 encircles the upper end of the shaft 30 and the sleeve 44 includes a thrust bearing or washer structure 46 received in a groove 48 in the shaft and engaging the upper end of the sleeve 44 that is welded to the plate 22 thus forming a thrust bearing for supporting the weight of the shaft 30. The lower end of the shaft 30 extends through the lower end of the housing and into a cylindrical sleeve 50 rigidly affixed to an elongated hollow box beam 52 with a transverse pin or bolt 54 extending through the sleeve 50 and the lower end of the shaft 30 thereby securing the beam 52 to the shaft 30 with the bearing 34 and other structural components of the shaft and supporting bracket and plate assembly enabling the beam 52 to rotate about a vertical axis in either a clockwise or counterclockwise direction.

The beam 52 has a punching bag 56 supported from one end thereof by an eye-bolt 58 adjustably extending through the end of the beam 52 and connected to a chain 60 which has four diverging chains 62 connected to the lower end thereof with the diverging chains being connected to supporting rings 64 secured to the punching bag 56 in a conventional and well-known manner thus suspending the punching bag 56 from the end of the beam 52 so that rotation of the beam 52 enables the punching bag 56 to move in a circular path about a vertical axis defined by the shaft 30.

At the opposite end of the beam 52 a swivel or caster wheel assembly 66 is mounted on an upwardly offset bracket 68 which is in the form of a short beam which forms an extension of the beam 52 as illustrated in FIGS. 1 and 3. The caster wheel assembly includes a rotatable wheel 70 with a U-shaped offset bracket 72 journalling the wheel for rotational movement. The bracket 72 is attached to a support member 74 by a vertical fastener bolt 76 and a ball bearing 78 is interposed between the bracket 72 and the support 74 for rotational movement about a vertical axis. A vertically disposed externally threaded bolt 80 is rigid with the support 74 and the fastener 76 with the bolt 80 being threaded thorough a sleeve nut 82 fixedly secured to bracket 68 for adjustment of the bolt 80 and wheel 70 in relation to the bracket 68 as illustrated in FIG. 4. The lower end of the bolt 80 is provided with a lock nut 84 and a washer 86 to adjustably secure the bolt 80 in relation to the bracket 68 and to vertically adjust the pressure of the wheel 70 against the platform 14. As illustrated the bracket 72 is offset so that the swivel or caster wheel will swivel about the axis of the bolt 76 and also rotate about a pivot axle 88 in the nature of a conventional caster wheel.

The platform 14 can be secured to any overhead support including a ceiling o a garage, recreation room, basement or gymnasium. When the punching bag 56 is punched, due to the offset relation of the support point for the punching bag in relation to the rotational axis of the shaft 30, the punching bag will rotate in either direction. The wheel 70 is adjustable which enables the speed of rotation to be increased or decreased to suit the needs of the individual user. Adjustment of the wheel will tighten or loosen the pressure of the wheel against the platform 14. Movement in clockwise or counterclockwise direction provides the user with the ability to improve leg work as well as punching skill and coordination and enables a boxer to train to fight a southpaw or left-handed boxer as well as a right-handed boxer. This device also eliminates the necessity of having a sparring partner thereby enabling the training procedure to proceed on a more positive schedule and avoids any possible injury to a sparring partner. The device can be used not only as a training aid for boxers but also to enable exercise regimens to be followed by various individuals.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination, a punching bags and a punching bag support comprising a generally horizontally disposed beam, means supporting an intermediate portion of said beam from an overhead support for rotational movement about a vertical axis, means at one end of said beam to support said punching bag, and an adjustable wheel, means at the other end of the beam to support said adjustable wheel adapted to engage with the overhead support to counteract the weight of the punching bag and enable the beam to rotate about a vertical axis in either direction with vertical adjustment of the wheel varying the rotational speed of the beam and punching bag suspended therefrom.

2. The structure as defined in claim 1 wherein said wheel is a caster wheel rotatable about a horizontal axis, said wheel including an offset swiveling supporting bracket having a threaded bolt depending therefrom, said beam including a nut threadedly receiving the bolt to enable the bolt and caster wheel to be adjusted vertically in relation to the beam.

3. The structure as defined in claim 1 wherein said means supporting the beam includes a vertical shaft, a swivel support for the vertical shaft, said swivel support including spaced brackets attached to an overhead support with the brackets being interconnected by a support member and the shaft extending through the support member and supported therefrom by thrust supporting means and a bearing structure.

4. The structure as defined in claim 3 wherein said means supporting the punching bag includes an eye-bolt extending through the beam and a supporting flexible member attached to the eye-bolt and to the punching bag.

5. The structure as defined in claim 4 wherein said rotational axis for the beam is located closer to the end thereof from which the punching bag is supported thereby providing a longer lever arm to the wheel to support the beam in substantially horizontal position.

* * * * *